US009444173B1

(12) United States Patent
Fabian et al.

(10) Patent No.: US 9,444,173 B1
(45) Date of Patent: Sep. 13, 2016

(54) RETRACTILE SOCKET ADAPTER FOR 12V OUTLET

(71) Applicant: FORD GLOBAL TECHNOLOGIES, LLC, Dearborn, MI (US)

(72) Inventors: Edgar Salazar Fabian, Mexico (MX); Jesus Guadalupe Castillo Maldonado, Mexico (MX)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/730,745

(22) Filed: Jun. 4, 2015

(51) Int. Cl.
*H01R 29/00* (2006.01)
*H01R 13/44* (2006.01)

(52) U.S. Cl.
CPC ..... *H01R 13/44* (2013.01)

(58) Field of Classification Search
CPC ..... H01R 13/7032; H01R 13/7033; H01R 13/703; H01R 24/46; H01R 2103/00
USPC ..... 439/188, 700, 668; 200/51.09
See application file for complete search history.

(56) References Cited

U.S. PATENT DOCUMENTS 3,196,228 A * 7/1965 Colenutt ..... H01R 13/53 200/51.07
3,982,084 A * 9/1976 Cooperstein ..... H01R 13/7036 200/51.09
4,703,986 A * 11/1987 McCormick ..... H01R 13/633 439/188
5,230,641 A * 7/1993 Wharton ..... H01R 13/2421 439/668
5,248,259 A * 9/1993 Naito ..... B60R 16/005 439/188
5,263,879 A * 11/1993 Sasa ..... B60N 3/14 439/668
5,649,840 A 7/1997 Muto
5,741,146 A * 4/1998 Henry ..... H01R 24/46 439/188
5,775,952 A * 7/1998 Lu ..... H01R 24/58 439/668
6,116,960 A * 9/2000 Lloyd ..... B60N 3/14 439/218
6,222,987 B1 * 4/2001 Duke ..... A47J 47/14 219/387

(Continued)

FOREIGN PATENT DOCUMENTS

KR 20020064562 A 8/2002
KR 100946847 B1 3/2010
KR 20100063927 A 6/2010

OTHER PUBLICATIONS

English machine translation for KR100946847.

(Continued)

*Primary Examiner* — Chandrika Prasad
*Assistant Examiner* — Vladimir Imas
(74) *Attorney, Agent, or Firm* — Vichit Chea; King & Schickli, PLLC

(57) ABSTRACT

A retractile power outlet assembly for a vehicle includes a socket body including a first electrical contact providing an electrical current from a power source and a displaceable retractile cap carrying a second electrical contact. A resilient member disposed in the socket body biases the displaceable cap away from the first electrical contact. In turn, a power plug is provided, configured for mating engagement with an interior of the socket body. The socket body further includes a holder cap against which the resilient member urges the displaceable retractile cap to sealingly occlude the socket body. The displaceable retractile cap further includes a head portion for carrying the second electrical contact, the head portion including a flange configured to receive a sealing gasket to provide that sealingly occluding fit. The head portion further includes a bore configured to receive the third electrical contact therethrough to touch the second electrical contact.

14 Claims, 5 Drawing Sheets

(56) References Cited

U.S. PATENT DOCUMENTS 6,682,356 B2 1/2004 Erez et al.
6,811,419 B2 * 11/2004 Bure ..... B60D 1/62 439/188
6,855,003 B1 * 2/2005 Wyant ..... H01R 13/2421 439/108
6,872,091 B2 * 3/2005 Huang ..... H01R 24/46 200/51.1
6,953,353 B2 * 10/2005 Lemkuil ..... H01R 13/447 439/133
7,264,392 B2 * 9/2007 Massabki ..... F21V 19/0005 200/51.12
7,381,070 B2 * 6/2008 Foo ..... H01R 33/962 200/51.09
7,484,995 B2 * 2/2009 Ding ..... H01R 13/7032 362/652
7,771,109 B2 * 8/2010 Huang ..... F21V 19/0005 362/249.01
7,819,552 B2 * 10/2010 Altamura ..... F21S 4/001 200/51.1
7,965,025 B2 * 6/2011 Dianqing ..... H01R 33/09 313/315
7,967,619 B2 * 6/2011 Dianqing ..... F21V 19/0005 439/188
7,980,871 B2 * 7/2011 Li ..... F21V 19/0005 439/188
8,079,856 B2 * 12/2011 Xiong ..... H01R 13/71 439/142
8,546,730 B2 * 10/2013 Schwarzbach ..... B60N 3/14 219/260
8,956,193 B2 * 2/2015 Tran ..... H05K 7/1069 439/66
9,096,149 B2 * 8/2015 Schwarzbach ..... H05B 1/0213
9,099,801 B2 * 8/2015 Holland ..... H01R 13/44
9,130,289 B2 * 9/2015 Leiba ..... H01R 13/20

OTHER PUBLICATIONS

English machine translation for KR20100063927.
English machine translation for KR20020064562.

* cited by examiner

RETRACTILE SOCKET ADAPTER FOR 12V OUTLET

TECHNICAL FIELD

This disclosure relates generally to vehicle power outlets. More particularly, the disclosure relates to a space-saving retractile socket adapter for a vehicle power outlet.

BACKGROUND

Modern motor vehicle consoles, dash panels, etc. typically include a variety of power outlets. Most conventionally, such power outlets are configured as 12V outlets, although it is also known to provide other types of outlets and data ports including USB plugs, power outlets of differing voltages, and the like. Often, outlets such as powerpoint outlets are provided with hinged covers to prevent intrusion of dust and debris when the outlet is not in use. Due to the limited amount of space provided in consoles, dash panels, etc. of motor vehicles, often such hinged covers interfere with other devices or systems. This creates problems in packaging the many required and customer-requested features into the vehicle console or dash panel.

To solve this and other problems, the present disclosure relates to a retractile socket adapter for a power outlet which does not require a cap or other covering structure and which further is substantially self-sealing when not in use.

SUMMARY

In accordance with the purposes and benefits described herein, in one aspect a retractile power outlet socket for a vehicle is described. The retractile power outlet socket includes a socket body having a first electrical contact to provide an electrical current from a vehicle power source. The socket further includes a displaceable retractile cap carrying a second electrical contact and a resilient member disposed to bias the displaceable cap away from the first electrical contact. The socket body further includes a holder cap against which the resilient member urges the displaceable retractile cap to sealingly occlude the socket body.

In embodiments, the displaceable retractile cap includes a head portion having a flange configured thereon to receive a sealing gasket and a bore configured to receive a power plug electrical contact therethrough.

In another aspect, a retractile power outlet socket assembly is described, including a retractile power outlet socket as described above and a substantially conventional power plug, such as a 12V power plug.

In the following description, there are shown and described embodiments of the disclosed retractile socket adapter. As it should be realized, the carrier is capable of other, different embodiments and its several details are capable of modification in various, obvious aspects all without departing from the devices and methods as set forth and described in the following claims. Accordingly, the drawings and descriptions should be regarded as illustrative in nature and not as restrictive.

BRIEF DESCRIPTION OF THE DRAWINGS

The accompanying drawing figures incorporated herein and forming a part of the specification, illustrate several aspects of the disclosed retractile socket adapter, and together with the description serve to explain certain principles thereof. In the drawing.

Reference will now be made in detail to embodiments of the disclosed retractile socket adapter, examples of which are illustrated in the accompanying drawing figures.

DETAILED DESCRIPTION

Figure 1A:
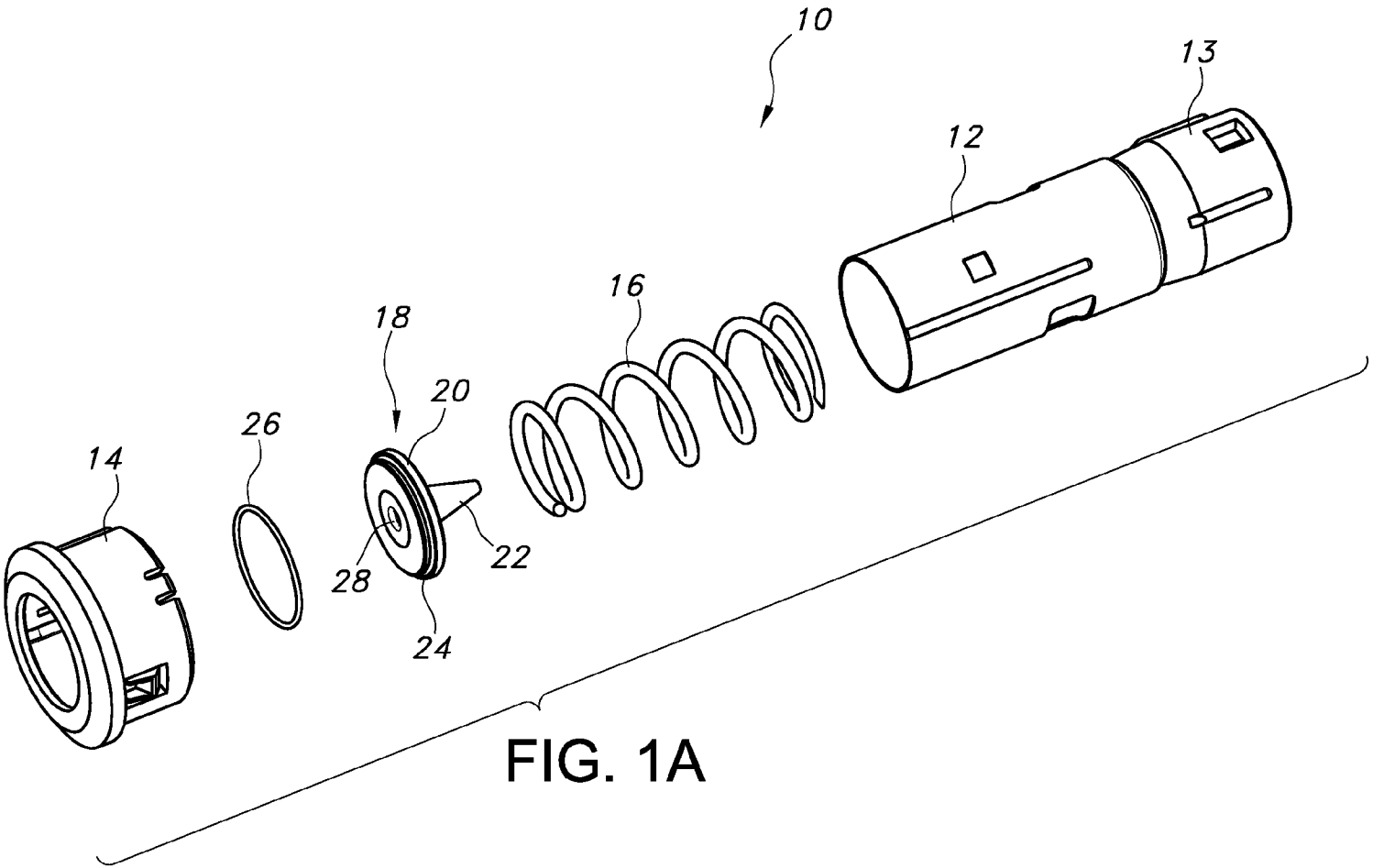
FIG. 1A depicts an exploded view of a retractile socket adapter according to the present disclosure.

Turning to FIG. 1, a power outlet assembly 10 is depicted, configured for receiving therein a conventional 12V power plug as is well known in the motor vehicle arts. In the depicted embodiment, the power outlet assembly 10 includes a cylindrical power outlet socket defined by a receptacle body 12 having an insulating portion 13 and a holder cap 14. A vehicle electrical contact (not visible in this view) is disposed at a distal end of the outlet body 12.

Internally, the outlet body 12 includes a resilient member 16, in the depicted embodiment being a coiled spring. However, it will be appreciated that a variety of resilient members are contemplated for use herein, including without intending any limitation such resilient members as a plurality of spring discs arrayed within the receptacle body 12.

A retractile cap 18 is provided, defined by a head 20 holding an electrical contact 22. In the depicted embodiment, electrical contact 22 is a substantially conical contact fabricated of any suitably electrically conductive material, for example copper or other conductive metal or metal alloy. However, it will be appreciated that any suitable configuration for electrical contact 22 is contemplated, such as cylindrical, rectangular, etc. In the depicted embodiment, the retractile cap head 20 includes a flange 24 configured to hold a gasket 26 in place. However, in alternative embodiments, for example wherein resilient member 16 is defined by a plurality of spring discs as described above, projecting rim 25 may be omitted.

Figure 1B:
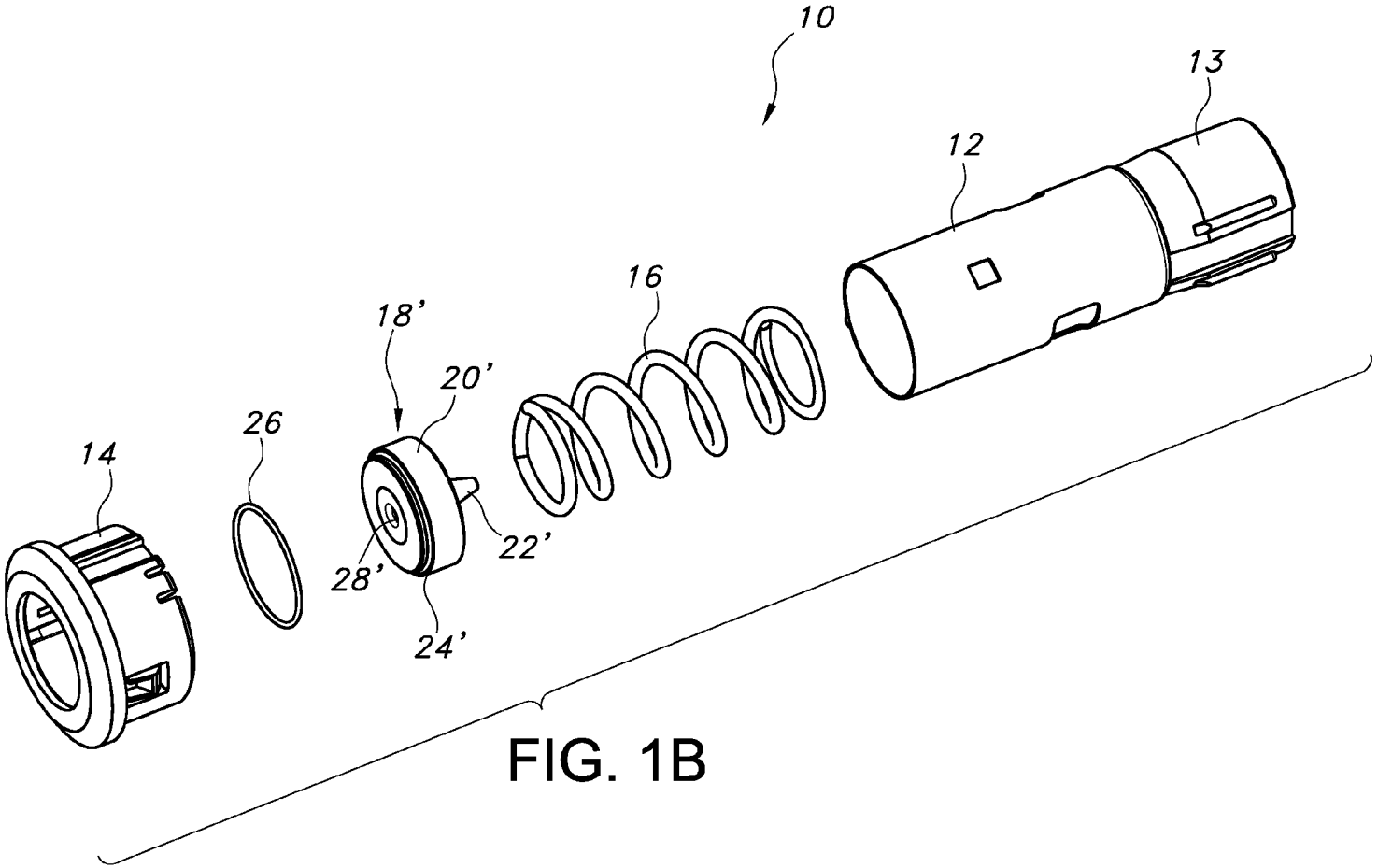
FIG. 1B depicts an alternative embodiment of the retractile socket adapter of FIG. 1.
Figure 2B:
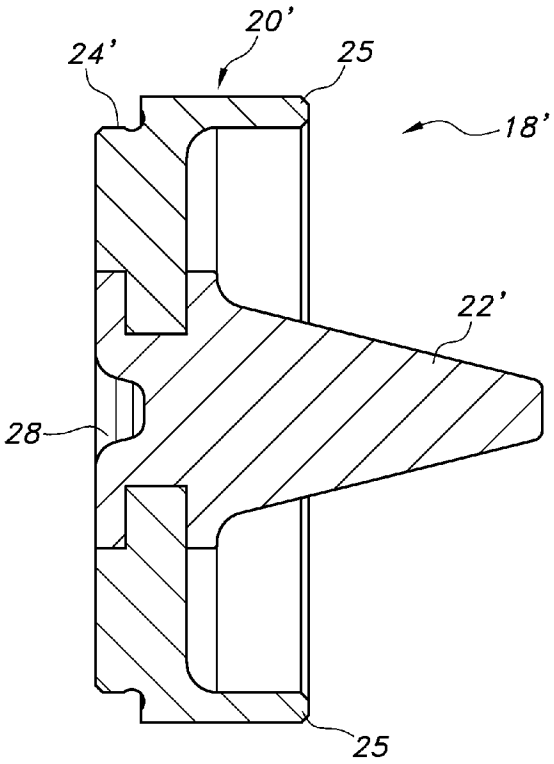
FIG. 2B depicts a side view of the retractile cap of FIG. 1B.
Figure 2A:
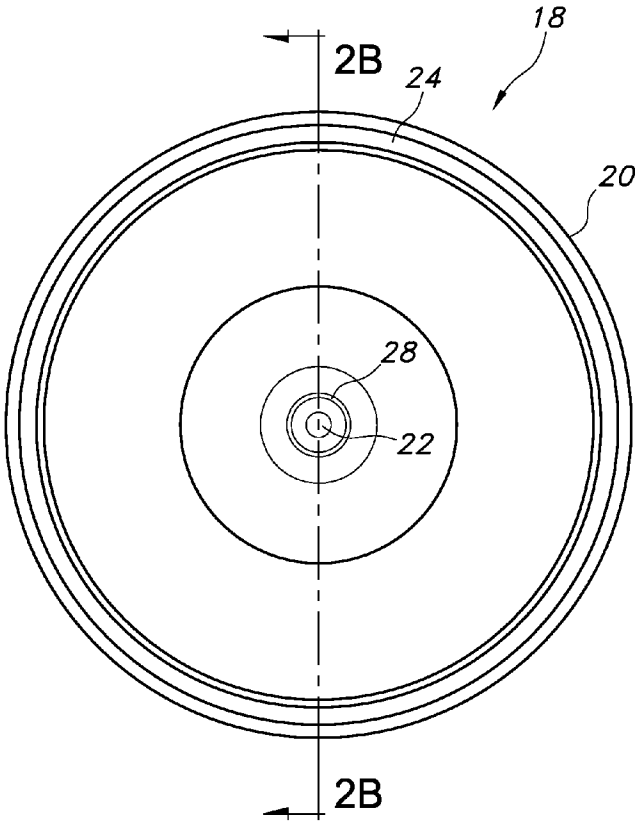
FIG. 2A depicts a top plan view of a retractile cap for the adapter of FIG. 1A.

In an alternative embodiment shown in FIG. 1B, a retractile cap 18' is provided, defined by a head 20' and an electrical contact 22'. As is apparent, head 20' defines a greater thickness dimension than that of the retractile cap head 20 of FIG. 1A due to inclusion of a projecting rim 25 (see FIG. 2B). Projecting rim 25 engages an end of the resilient member 16 (see FIG. 3A) to hold resilient member 16 in place. As before, the retractile cap head 20 includes a flange 24' configured to hold a gasket 26. As shown in FIGS. 2A-2B, retractile cap head 20 includes a bore 28 passing therethrough to expose a portion of the electrical contact 22 for accessibility by a 12V power plug electrical contact (not shown, but see FIGS. 3A-3B and the discussion infra), via bore 28.

Figure 3A:
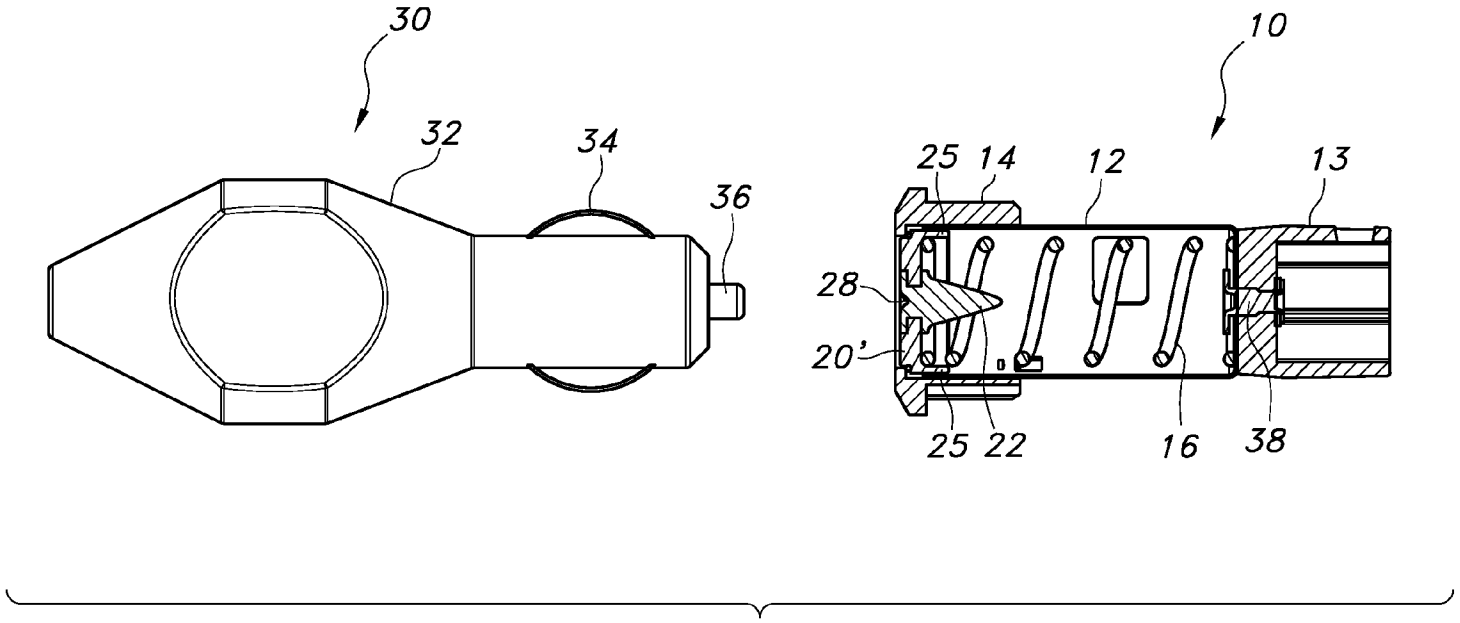
FIG. 3A shows a side view of a power plug and a retractile socket adapter according to the present invention.

Turning now to FIG. 3A, a substantially conventional 12V power plug 30 is depicted. Such plugs 30 are well known in the art and need not be exhaustively described herein. However, at a high level the plug 30 includes a body 32, one or more resilient bands 34 for centering the plug within an electrical socket, and an exposed power plug electrical contact 36. Of course, wiring (not shown) is typically included to convey an electrical current to a device (not shown) powered by way of power plug 30.

The power outlet assembly 10 shown in FIG. 3A is substantially as described above, and includes an outlet electrical contact 38 disposed within the insulating portion 13. Of course, wiring (not shown) would be included for conveying an electrical current from a source of electrical power such as an automotive battery (not shown) to the power outlet assembly 10. Here, the power outlet assembly 10 is depicted in an "at rest" or "safe" configuration, i.e. no electrical circuit has been completed. In this resting or safe configuration, resilient member 16 biases retractile cap 18 against holder cap 14 as shown, preventing the completion of an electrical circuit and also, by retractile cap head 20 and gasket 26, preventing intrusion of dust and/or debris into an interior of the power outlet. Still further, retractile cap 18 in this configuration prevents inadvertent touching of a potentially live electrical contact, and injury resulting therefrom, without requiring a separate physical cover or cap for the outlet.

Figure 3B:
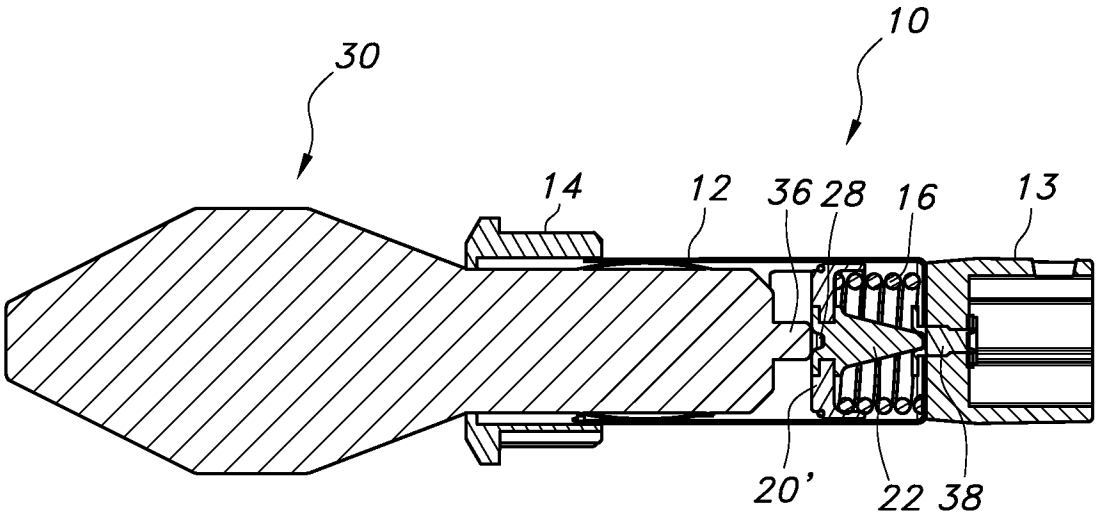
FIG. 3B depicts the power plug and retractile socket adapter of FIG. 3A in a mated engagement.

Turning to FIG. 3B, as shown the power plug 30 and power outlet assembly 10 have been brought into a mating configuration, with plug 30 placed in an interior of the power outlet. As shown, plug electrical contact 36 contacts power outlet electrical contact 22 by way of bore 28 through retractile cap 20. As plug 30 is advanced into an interior of power outlet 10, resilient member 16 compresses, and power outlet electrical contact 22 is urged into contact with power outlet electrical contact 38. In this fashion, an electrical circuit is completed, and electrical power can transfer from a remote source of electrical power (for example an automotive battery) connected to power outlet 10 to one or more devices connected to power plug 30. In turn, once a user does not require electrical power from power outlet 10, on removing power plug 30 resilient member 16 biases power outlet electrical contact 22 away from power outlet electrical contact 38, returning the power outlet 10 to the "safe" configuration shown in FIG. 3A.

Thus, it will be appreciated that a simple yet effective power outlet configuration is provided for a vehicle, requiring no hinged cap or other structure for preventing a user from inadvertently touching live electrical contact, and also advantageously preventing intrusion of dust, debris, and other harmful substances into the power outlet. Conveniently, the described power outlet is placed in a safe, closed configuration merely by removing a power plug therefrom. Obvious modifications and variations are possible in light of the above teachings. All such modifications and variations are within the scope of the appended claims when interpreted in accordance with the breadth to which they are fairly, legally and equitably entitled.

What is claimed:

1. A retractile power outlet socket for a vehicle, comprising:

a socket body including a first electrical contact providing an electrical current from a vehicle power source;

a displaceable retractile cap including a head portion for carrying a second electrical contact, the head portion including a flange for receiving a sealing gasket; and a resilient member disposed to bias the displaceable cap away from the first electrical contact.

2. The socket of claim 1, wherein the socket body further includes a holder cap against which the resilient member urges the displaceable retractile cap to sealingly occlude the socket body.

3. The socket of claim 1, wherein the head portion further includes a bore configured to receive a power plug electrical contact therethrough.

4. The socket of claim 1, wherein the second electrical contact defines a substantially conical shape manufactured of an electrically conductive substance.

5. A vehicle including the socket of claim 1.

6. A retractile power outlet assembly for a vehicle, comprising:

a socket body including a first electrical contact providing an electrical current from a vehicle power source;

a displaceable retractile cap including a head portion for carrying a second electrical contact, the head portion including a flange for receiving a sealing gasket;

a resilient member disposed to bias the displaceable cap away from the first electrical contact; and a power plug configured for mating engagement with an interior of the socket body.

7. The assembly of claim 6, wherein the socket body further includes a holder cap against which the resilient member urges the displaceable retractile cap to sealingly occlude the socket body.

8. The assembly of claim 6, wherein the second electrical contact defines a substantially conical shape manufactured of an electrically conductive substance.

9. The assembly of claim 6, wherein the power plug includes a third electrical contact.

10. The assembly of claim 9, wherein the head portion further includes a bore configured to receive the third electrical contact therethrough to contact the second electrical contact.

11. A vehicle including the assembly of claim 6.

12. A method for completing an electrical circuit in a retractile power outlet assembly for a vehicle, comprising:

providing a retractile power outlet according to claim 1;

providing a power plug including a third electrical contact; and advancing the power plug into an interior of the retractile power outlet socket body whereby the third electrical contact urges the displaceable retractile cap second electrical contact against the socket first electrical contact to complete an electrical circuit.

13. The method of claim 12, including providing the displaceable retractile cap having the head portion including a bore configured to receive the third electrical contact therethrough to touch the second electrical contact.

14. The method of claim 12, further including removing the power plug from the socket body interior whereby the resilient member urges the displaceable retractile cap away from the first electrical contact and against a holder cap to discontinue the electrical circuit and sealingly occlude the socket body.

* * * * *